US010472726B2

(12) United States Patent
Mevellec et al.

(10) Patent No.: US 10,472,726 B2
(45) Date of Patent: Nov. 12, 2019

(54) ELECTROLYTE AND PROCESS FOR ELECTROPLATING COPPER ONTO A BARRIER LAYER

(71) Applicant: ALCHIMER, Massy (FR)

(72) Inventors: Vincent Mevellec, Chaville (FR); Dominique Suhr, Chatenay-melabry (FR); Laurianne Religieux, Paris (FR)

(73) Assignee: ALCHIMER, Massy (FR)

( * ) Notice: Subject to any disclaimer, the term of this patent is extended or adjusted under 35 U.S.C. 154(b) by 747 days.

(21) Appl. No.: 14/429,584

(22) PCT Filed: Aug. 28, 2013

(86) PCT No.: PCT/FR2013/051987

§ 371 (c)(1),
(2) Date: Mar. 19, 2015

(87) PCT Pub. No.: WO2014/044942

PCT Pub. Date: Mar. 27, 2014

(65) Prior Publication Data

US 2015/0218724 A1 Aug. 6, 2015

(30) Foreign Application Priority Data

Sep. 24, 2012 (FR) ..... 12 58925

(51) Int. Cl.
*C25D 3/38* (2006.01)
*C25D 7/12* (2006.01)

(52) U.S. Cl.
CPC ..... *C25D 3/38* (2013.01); *C25D 7/12* (2013.01); *C25D 7/123* (2013.01)

(58) Field of Classification Search
CPC ..... C25D 3/38–40; C25D 7/12–126; C25D 17/002
See application file for complete search history.

(56) References Cited

U.S. PATENT DOCUMENTS 3,617,451 A 11/1971 Slominski et al.
2006/0243599 A1* 11/2006 Shih ..... C25D 3/38 205/261

(Continued)

FOREIGN PATENT DOCUMENTS

FR 2930785 11/2009
JP H01-219187 A * 9/1989 ..... C25D 3/38

(Continued)

OTHER PUBLICATIONS

Haga et al., machine translation, JP H01-219187 A (1989).*

(Continued)

*Primary Examiner* — Bryan D. Ripa
*Assistant Examiner* — Ho-Sung Chung
(74) *Attorney, Agent, or Firm* — Hamre, Schumann, Mueller & Larson, P.C.

(57) ABSTRACT

The subject of the present invention is an electrolyte composition for depositing copper on semiconductor substrates covered with a barrier layer.
This electrolyte contains the combination of imidazole and 2,2'-bipyridine, used as suppressor, and of thiodiglycolic acid, used as accelerator.
The combination of these additives makes it possible to obtain a bottom-up filling on trenches of very small width, typically of less than 100 nm.

25 Claims, 1 Drawing Sheet

(56) References Cited

U.S. PATENT DOCUMENTS

| | | | | |
|---|---|---|---|---|
| 2007/0062818 | A1* | 3/2007 | Daviot | C25D 3/38 205/291 |
| 2009/0038951 | A1* | 2/2009 | Hayashi | C25D 3/38 205/291 |
| 2009/0294293 | A1 | 12/2009 | Zahraoui et al. | |

FOREIGN PATENT DOCUMENTS

| | | |
|---|---|---|
| WO | 2007034116 | 3/2007 |
| WO | 2007096390 | 8/2007 |
| WO | 2011154493 | 12/2011 |

OTHER PUBLICATIONS

Haga et al., partial human translation, JP H01-219187 A (1989).*
International search report for International application No. PCT/FR20131051987, dated Jul. 11, 2013 (2 pages).

* cited by examiner

ELECTROLYTE AND PROCESS FOR ELECTROPLATING COPPER ONTO A BARRIER LAYER

The present invention relates to the electroplating of copper onto a semiconductor substrate. More specifically, it relates to a process for electroplating copper onto the surface of a semiconductor substrate exhibiting an etching, the surface being covered with a copper diffusion barrier layer.

Integrated circuits are generally manufactured by formation of active semiconductor devices, especially transistors, at the surface of silicon wafers, said semiconductor devices being connected together by a system of submicron metal interconnections obtained by filling "trenches" sunken into the dielectric layers. The width of these lines is generally of the order of one to several hundred nanometres.

The submicron interconnection elements are generally formed by using the Damascène process (see for example S. Wolf, "Silicon processing for the VLSI Era", Vol. 4, (2002), p. 671-687) according to a sequence of steps comprising: —the etching of lines on the silicon surface; —the deposition of an insulating dielectric layer (generally consisting of silicon oxide or nitride); —the deposition of a barrier layer that is used to prevent the migration of copper; —the deposition of a thin layer of metallic copper, referred to as a seed layer; —the filling of the trenches by electroplating of copper in an acid medium; and—the removal of the excess copper by polishing.

The barrier layer generally has too high a resistance to enable a deposit of copper that is homogeneous or uniform on the scale of the trench via an electrochemical route, mainly due to the ohmic drop phenomenon. The high resistance of the barrier layer results from the high resistivity of the material and from its smallness of its thickness. It is therefore generally necessary, prior to the step of filling by electroplating of copper, to cover the barrier layer with a thin layer of metallic copper, referred to as a seed layer, in order to improve the conductivity of the substrate to be coated during the step of filling by electroplating. In fact, the copper electroplating techniques conventionally used for filling trenches with copper, after the step of forming a copper seed layer, cannot be used on resistive substrates such as barrier layers.

The demand for the manufacture of semiconductor integrated circuits such as computer chips of high power, of high storage density and of low dissipation requires the reduction in the size of the structures. The reduction in the size of the chips and the increase in the density of the circuits in turn require a miniaturization of the interconnection devices.

When the trenches reach too small a size, it becomes difficult or even impossible to deposit a copper seed layer prior to the filling, for want of sufficient space in the device. For example, if the trench has a width of 20 nm, the thickness of the seed layer cannot exceed 5 nm, however, the processes for depositing copper in the vapour phase do not enable the deposition of layers that are thin enough and of regular thickness (conformal deposition).

In order to fill increasingly thin interconnection structures, there is therefore a need to have electrolytes that enable the conformal deposition of very thin copper seed layers on barrier substrates. There is also a need to do away with the prior deposition of the seed layer, by providing an electrolyte that enables the filling with copper over an irregular or discontinuous seed layer, or even the filling with copper directly onto the barrier layer. Indeed, the reduction in the thickness of the copper seed layer deposited on the barrier layer is imposed by the miniaturization of the interconnection elements. However, the evenness of the thickness of the seed layer is generally necessary in order to guarantee a constant current density over the entire surface to be metallized during the filling step, so that the copper deposit is of good quality.

The invention especially finds an application in the field of integrated circuits for the manufacture of interconnection elements, the size of which does not exceed one micron. The invention in particular finds an application for the electroplating of copper into trenches and other small elements such as small vias for which the surface width (also referred to as the opening diameter) of the semiconductor is less than 200 nm.

There are in the prior art electrolytes for the metallization of through-silicon vias (TSVs) necessary for the integration of three-dimensional electronic chips. These structures are much larger than the submicron structures targeted by the present invention: TSVs generally have an opening diameter of the order of 10 to 250 microns. The electrolytes used for filling the TSVs have specific chemistries and are not suitable for filling much smaller structures such as interconnection lines.

In addition it has been observed that the conventional electrolytes used for the electroplating of copper in trenches do not work on thinner patterns and patterns for which the aspect ratio is higher, typically greater than 2/1 (remember that the aspect ratio corresponds to the ratio between the depth of the pattern and the width of its opening at the surface of the substrate). In particular, it is observed at the end of the filling step that voids may be formed in the copper deposited in such trenches, which has a tendency to increase the resistance or even to give rise to a break in the conductive line intended to be formed by the copper deposited in the patterns. The voids may be located between the substrate and the copper deposit, or in the copper deposit itself, generally in the form of a line equidistant from the edges of the trench.

The preoccupation of combining the efficiency of the processes and the cost price has always driven the industry to constantly improve the formulations of electrolytes. Thus, the applicant has filed several patent applications relating to copper electroplating compositions that make it possible to produce seed layers on barrier layers in interconnection elements or TSVs.

Electroplating compositions are known, from document WO 2007/034116, that make it possible to produce adherent, conformal and uniform deposits of copper seed layers on resistive barriers. The formulations described in this document are designed for the production of ultra-thin deposits, usually having a thickness of less than 20 nm, on substrates having resistivities of the order of a few tens of ohms/square. It has been observed that such formulations cannot be used during the subsequent step of filling trenches with copper: this is because voids or seams appear in the copper deposit with this type of electrolyte.

In patent application FR 2 930 785, the applicant described an electroplating process specifically provided for the deposition of a seed layer in through-silicon vias. This technology, specific to through-silicon vias, cannot be transferred to the metallization of very thin interconnection lines.

Finally, electroplating compositions are known, from document WO 2007/096390, that make it possible to fill—in only one step on the copper barrier—interconnection lines and holes with copper. The formulations described in this prior document are specifically designed to respond to the problem of filling interconnection lines and holes of small volume. However, it has been observed that the compositions illustrated by the examples mentioned in document WO 2007/096390 do not enable trenches to be filled within a time that is compatible with industrial manufacture.

Under these conditions, the purpose of the present invention is to solve the technical problem consisting of the provision of a novel electrolyte that complies both with the filling constraints generated by the thinness of certain trenches, and of the profitability requirements of the industry relating to the filling times.

To date, the conventional electroplating of copper comprises the application of a current to a wafer previously covered with a seed layer and submerged in an acid bath of copper sulphate containing additives, mainly of accelerator, suppressor, leveller or brightener type. The prior art suggests that, in order to carry out the filling of the patterns, it is preferable to use an accelerator and a suppressor in combination, and in certain cases, a three-component system consisting of an accelerator, a suppressor and a leveller.

According to the known electroplating processes, copper has a tendency to grow more quickly at the opening of the trench than at the bottom thereof. A gradient is observed in the rates of copper filling in the trenches which generally leads to the formation of a seam located equidistant from the walls of the trench. It is therefore desirable to increase the growth of copper at the bottom of the trench in order to limit the appearance of voids in the copper deposit.

Furthermore, a continuous copper layer will generally have a greater thickness at the top of the trench at the surface of the substrate. It is desirable to limit the thickness of the layer at the flat part since, the electroplating step is followed by a polishing step necessary for removing the excess copper present on the flat part.

Thus, the reduction in thickness of the copper present on the flat part of semiconductor substrates and the absence of defects in the copper deposit in the trenches are very important elements in the manufacture of integrated circuits.

The suppressors and accelerators are therefore incorporated into the electrolytic baths, in order to make it possible, respectively, to slow down and/or to accelerate the deposition of copper at the desired locations of the trench.

Once the electrodes are biased, a suppressor will be able to be adsorbed at the surface to be coated (a barrier layer or a seed layer of copper for example), and begin to slow down the growth of copper. The adsorption of the suppressor on the surface leads to partial masking of the surface, which has the effect of slowing down the growth of the copper locally.

Conventional suppressors are, for example, polymers of high molecular weight, generally of the order of 2000 g/mol to 8000 g/mol, such as polypropylene glycols, polyethylene glycols and polyethers. They are generally added to the electroplating solutions in order to be specifically adsorbed on a copper seed layer, previously deposited at the surface of the wafer, in order to slow down the growth kinetics of the copper at the entry to interconnection line structures (opening of trenches).

The suppressors that slow down the growth of the copper at the surface of the trenches may be combined with small-sized molecules, accelerators, which will have the property of catalyzing the growth of the copper at the bottom of the etched patterns. The accelerator is chosen in order to be adsorbed on a copper seed layer or on a layer of barrier material. For example, an accelerator specific to copper acts on the modification of the mechanisms of copper reduction, which results in an increase of the kinetics. The accelerator generally comprises small-sized molecules with a high diffusion rate that reach the bottom of the structures more rapidly than the suppressors which are large-sized molecules. The accelerator most commonly used is bis(3-sulphopropyl)disulphide (also known as SPS).

It has been discovered that the combination of imidazole and bipyridine can fulfil the role of suppressor, in particular of suppressor suitable for being adsorbed onto a barrier layer or onto copper.

Bipyridine is already known as a copper complexing agent for stabilizing the copper ions in electroplating baths (WO 2007/034116). It is also known as a brightener for the metallization of steel by copper when it is used at a very high concentration, of the order of 100 mM (U.S. Pat. No. 3,617,451). Its suppressor properties have however never been described.

Without being tied to any theory, it is believed that imidazole and bipyridine are active from the biasing of the substrate onwards and begin to slow down the growth of copper from the start of the process.

It has also been discovered within the context of the present invention that imidazole combined with bipyridine makes it possible, quite unexpectedly, to increase the number of nucleation grains at the surface of the substrate to be coated, so much so that the substrate is very rapidly covered over the whole of its surface with a thickness of copper that is both very thin and continuous. The electrical continuity of the substrate is thus guaranteed in the very first instance of the electroplating reaction, which makes it possible, depending on the variant of the process chosen, i) to do away with a prior step of depositing a copper seed layer, or else ii) to deposit a continuous and conformal seed layer of very thin thickness allowing a space saving in trenches of very small dimensions.

It has also been discovered that it was possible to solve the abovementioned technical problem with the aid of electroplating compositions comprising the combination of a suppressor with a particular accelerator. This particular accelerator makes it possible to nullify the suppressor effect in the bottom of the trenches since it accumulates greatly at this location and enters into competition with the suppressor effect of the imidazole/bipyridine pair. The inventors have discovered that other accelerators do not make it possible to nullify the suppressor effect of the imidazole/bipyridine pair in the bottom of the patterns.

The combination of bipyridine, imidazole and thiodiglycolic acid according to the invention makes it possible to fill the trenches without any defect being observed. The trenches thus filled do not have voids or seams: the filling is optimal from the bottom to the top of the trenches (bottom-up effect).

The combination of bipyridine, imidazole and thiodiglycolic acid according to the invention additionally makes it possible to stabilize the electrolyte over time, especially during the storage of the electrolyte.

This unexpected effect cannot be observed with another accelerator from the prior art. Indeed, the inefficiency of another accelerator, SPS, was demonstrated experimentally in a comparative example, when it is used in combination with imidazole and bipyridine. SPS disturbs the action of the other two compounds and renders them ineffective.

This effect cannot be observed either with another suppressor such as the combination of bipyridine with another aromatic amine having a structure similar to that of imidazole, such as pyridine, which reinforces the unexpected nature of the present invention.

Thus, according to one of its aspects, one subject of the present invention is an electrolyte for electroplating copper on a copper-diffusion barrier layer, the electrolyte comprising a source of copper ions, a solvent, and the combination of bipyridine, imidazole and thiodiglycolic acid.

According to a second aspect, one subject of the present invention is an electrolyte for electroplating copper onto a copper-diffusion barrier layer, the electrolyte comprising a source of copper ions, a solvent, and the combination of a suppressor and an accelerator, characterized in that the suppressor comprises the combination of bipyridine and imidazole, and the accelerator is thiodiglycolic acid.

The pH of the electrolyte is preferably chosen to be greater than 6.7. This is all the more surprising since the electrolytes from the prior art used for filling cavities generally have a much lower pH in order to guarantee a sufficient conductivity of the solution owing to the presence of $H^+$ ions, and consequently, in order to obtain sufficient kinetics. The pH of the electrolyte of the invention is preferably greater than 6.7, more preferably greater than 6.8, more preferably between 7.5 and 8.5, and more preferably still of the order of 8.

It has moreover been shown that the electrolyte of the invention makes it possible to fill very thin trenches that have high aspect ratios, of 2:1 and above, for example greater than 3:1, without material defect.

The term "electroplating" is understood here to mean a process that makes it possible to cover a surface of a substrate with a metallic or organometallic coating, in which the substrate is electrically biased and brought into contact with a liquid containing precursors of said metallic or organometallic coating, so as to form said coating. When the substrate is electrically conductive, the electroplating is for example carried out by passing a current between the substrate to be coated that forms one electrode (the cathode in the case of a metallic or organometallic coating) and a second electrode (the anode) in a bath containing a source of precursors of the coating material (for example metal ions in the case of a metallic coating) and optionally various agents intended to improve the properties of the coating formed (uniformness and thinness of the deposit, resistivity, etc.), optionally in the presence of a reference electrode. By international convention, the current and the voltage applied to the substrate of interest, that is to say to the cathode of the electrochemical circuit, are negative. Throughout this text, when these currents and voltages are mentioned with a positive value, it is implicit that this value represents the absolute value of said current or of said voltage.

The term "electrolyte" is understood to mean the liquid containing precursors of said metallic coating used in an electroplating process as defined previously.

The term "suppressor" is understood to mean a substance suitable for being adsorbed at the surface of the barrier layer or at the surface of the copper which will have been deposited on the barrier layer at the start of and during the electroplating process, which has the role of partially masking the surface to be coated so as to slow down the reaction that takes place at this surface.

The term "accelerator" is understood to mean a substance suitable for accelerating the growth of the copper at the bottom of the trench. The accelerator acts on the modification of the reduction mechanisms of copper, which results in an increase in the deposition kinetics of the metal.

The interaction between the copper ions, the imidazole, the bipyridine and the thiodiglycolic acid makes it possible to fill trenches having very small widths in times that are compatible with an industrial application.

Generally, the electroplating composition according to the invention comprises a source of copper ions, in particular of $Cu^{2+}$ cupric ions.

Advantageously, the source of copper ions is a copper salt such as, in particular, copper sulphate, copper chloride, copper nitrate, copper acetate, preferably copper sulphate, and more preferably copper sulphate pentahydrate.

According to one particular feature, the source of copper ions is present within the electroplating composition at a concentration between 0.4 and 40 mM, for example between 1 and 25 mM, and more preferably between 3 and 6 mM.

The bipyridine is preferably in the form of 2,2'-bipyridine.

The bipyridine may optionally be replaced by or used in combination with an amine chosen from aromatic amines—in particular 1,2-diaminobenzene or 3,5-dimethylaniline—and nitrogen-containing heterocycles, in particular pyridine, 8-hydroxyquinoline sulphonate, 1,10-phenanthroline, 3,5-dimethyl-pyridine, 2,2'-bipyrimidine or 2-methylaminopyrimidine.

The concentration of bipyridine is preferably between 0.4 and 40 mM, preferably between 1 and 25 mM, for example between 3 and 6 mM. The bipyridine preferably represents from 0.5 to 2, more preferably from 0.75 to 1.25 molar equivalents, more preferably of the order of 1 molar equivalent of the concentration of copper ions.

Advantageously, the thiodiglycolic acid is present, within the electroplating compositions according to the invention, at a concentration between 1 and 500 mg/l, preferably between 2 and 100 mg/l.

The concentration of imidazole is preferably between 1.2 and 120 mM, preferably between 3 and 75 mM, for example between 9 and 18 mM.

Imidazole preferably represents from 1 to 5, more preferably from 2 to 4 molar equivalents, more preferably of the order of 3 molar equivalents of the concentration of copper ions.

The electrolyte may additionally comprise a copper complexing agent which may have the role of preventing the precipitation of copper hydroxide in a neutral or basic medium. Furthermore, the complexing agent may also have the effect of modifying the electrochemical properties of the copper for the purpose of optimizing the growth mechanisms, and of stabilizing the electrolyte. The electrolyte may be free of pyridine.

Although there is no restriction in principle regarding the nature of the solvent (provided that it sufficiently solubilises the active species of the solution and does not interfere with the electroplating), it will preferably be water. According to one method of implementation, the solvent predominantly comprises water by volume.

Advantageously, the electrolyte of the invention comprises less than 50 ppm of chlorine ions. In the prior art, a source of chlorine ions is generally introduced into the electrolyte in order to stabilize a suppressor. Within the context of the present invention, it has been discovered on the other hand that it is not necessary to add chlorine ions for the effectiveness of the solution. The electrolyte of the invention is preferably free of chlorine ions.

According to one variant of the invention, the electrolyte comprises, besides imidazole and bipyridine, another additional suppressor specific to copper that is known from the prior art, such as polyethylene glycol polymers.

More advantageously, the electrolyte may comprise a leveller and/or a brightener that are known from the prior art, such as for example a polypyridine.

According to one particular embodiment, the electrolyte comprises, in aqueous solution:

copper sulphate, at a concentration between 0.4 and 40 mM;

a mixture of imidazole and thiodiglycolic acid;

2,2'-bipyridine;

the pH of said composition being between 7.5 and 8.5.

The electrolyte described in this variant makes it possible, via implementation of the process according to the second aspect of the invention, to fill the trenches without forming holes (voids) expressing an optimal bottom-up filling of the trenches.

According to one particular embodiment, the concentration of copper ions is between 0.4 and 40 mM, the concentration of bipyridine is between 0.4 and 40 mM, the concentration of imidazole is between 1.2 and 120 mM, and the concentration of thiodiglycolic acid is between 1 and 500 mg/l.

The invention also proposes, according to a third aspect, a process for electroplating copper onto a copper-diffusion barrier layer, and which is optionally covered with a seed layer, the barrier layer covering one surface of a semiconductor substrate, the surface of the substrate having a flat part and a set of at least one trench having a width of less than 200 nm, the process comprising the steps of:

- bringing the barrier layer into contact with an electrolyte according to the first or second aspect of the invention,
- biasing of the surface of said barrier layer at an electric potential that enables the electroplating of copper onto the barrier layer or the copper seed layer, so as to form a copper deposit on said barrier layer.

All the features which were described in connection with the first and the second aspect of the invention apply to the electroplating process.

This process may consist of the deposition of a copper seed layer on the barrier layer, or alternatively, if the bias time is extended, of a complete filling of said trench by said copper deposit by depositing copper directly onto the barrier layer not previously covered with a copper seed layer.

The seed layer deposited preferably has a thickness between 1 and 30 nm, for example between 2 and 20 nm.

The process of the invention makes it possible to fill trenches of very small width. Thus, the width of the trenches may be below an upper limit chosen from the group consisting of 150 nm, 100 nm, 75 nm, 35 nm, 25 nm and 10 nm. The width of the trenches may be equal to 32 nm, 22 nm, 14 nm, 10 nm or even 7 nm.

During the filling step, the surface of the cavity to be filled may be biased, either in galvanostatic mode (fixed set current), or in potentiostatic mode (fixed set potential, optionally relative to a reference electrode), or else in pulsed mode (either the current or the voltage being pulsed).

According to one embodiment of the invention, the bias of the surface of the cavity to be filled is produced in DC mode by applying a current per unit area within a range from 0.2 mA/cm$^2$ to 50 mA/cm$^2$, preferably from 0.5 mA/cm$^2$ to 5 mA/cm$^2$, and preferably from 0.5 to 1.5 mA/cm$^2$.

According to another embodiment of the invention, the bias of the surface of the cavity to be filled is produced in galvano-pulsed or potentio-pulsed mode at medium or high frequency.

The bias of the surface may be produced, for example, in galvano-pulsed mode by applying an alternation of bias periods and rest periods without bias. The frequency of the bias periods may be between 0.1 kHz and 50 kHz (i.e. a bias time between 0.02 ms and 10 ms), preferably between 1 kHz and 20 kHz, for example between 5 kHz and 15 kHz, whilst the frequency of the rest periods may be between 0.1 kHz and 50 kHz, preferably between 1 kHz and 10 kHz, for example 5 kHz. The bias of the surface may be produced by applying a current of maximum intensity between 0.01 and 10 mA/cm$^2$, for example of the order of 4 to 5 mA/cm$^2$.

The filling time for trenches having a width of less than 150 nm is advantageously between 30 seconds and 10 minutes in order to obtain a complete filling of the trenches. In one embodiment, the duration of the electroplating step is less than 5 minutes in order to obtain a complete filling of trenches having a width of less than 100 nm and having a depth of less than 200 nm.

The electrolytes according to the invention may be used in accordance with a process comprising an initial "hot entry" step, but particularly advantageously, they may also be used in accordance with a process comprising an initial "cold entry" step, during which the surface to be coated is brought into contact, without electrical bias, with the electroplating bath, and kept in this state for the desired time. Thus, according to one particular feature, the process in accordance with the invention comprises, prior to the electroplating, a "cold entry" step during which the surface of the cavity to be filled is brought into contact with the electroplating composition according to the invention, without electrical bias, and optionally kept in this state for a time of at least 30 seconds.

The electrolytes according to the invention will preferably be used in an electroplating process comprising:

- a "cold entry" step during which said surface to be coated is brought into contact, without electrical bias, with an electroplating bath and preferably kept in this state for a time of at least 5 seconds, preferably between 10 and 60 seconds, and more preferably from around 10 to 30 seconds;
- a step of forming the coating during which said surface is biased for a sufficient time to form said coating;
- a "hot exit" step during which said surface is separated from the electroplating bath whilst it is still under electrical bias.

The combination of a cold entry step and a hot exit step in this process makes it possible to obtain, under easy and reproducible conditions, a better adhesion of the copper deposited on the substrate.

During the step of forming the coating, the surface is biased for a sufficient time to form said coating. This time is at least 5 seconds, preferably between 10 seconds and 10 minutes.

According to another particularly advantageous feature, the filling process according to the invention may be carried out at a temperature between 20 and 30° C., that is to say at ambient temperature. It is not therefore necessary to heat the electroplating bath, which is an advantage from the point of view of the simplicity of the process.

The process in accordance with the invention has made it possible to produce copper fillings of excellent quality, without material defect.

This process can be used to fill a cavity in which the surface of the barrier layer is at least partially covered with a copper seed layer.

Advantageously, the process in accordance with the invention may also be used to fill a cavity, the surface of which consists of a material that forms a copper-diffusion barrier, which is not covered with a copper seed layer.

A layer that forms a copper-diffusion barrier may comprise at least one of the materials chosen from cobalt (Co), ruthenium (Ru), tantalum (Ta), titanium (Ti), tantalum nitride (TaN), titanium nitride (TiN), tungsten (W), titanium tungsten (TiW) and tungsten carbonitride (WCN). The copper-diffusion barrier layer preferably consists of ruthenium or cobalt. The thickness of the barrier layer is generally between 1 and 30 nm.

If a support is provided that is covered with a tantalum barrier layer, it will be preferred to cover the support with a copper seed layer before carrying out the process of the invention.

The invention is illustrated in greater detail by the following figures and examples.

EXAMPLE 1

Figure 1:
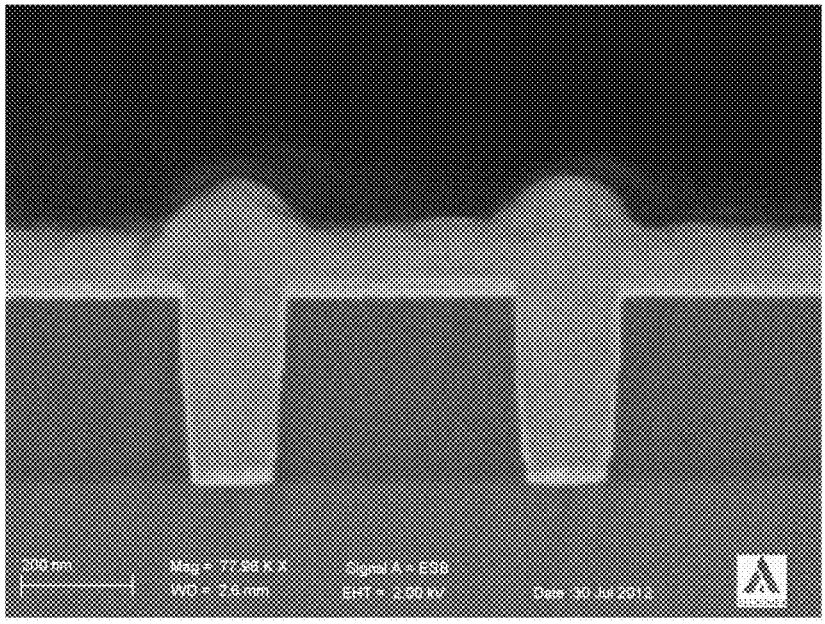
FIG. 1 represents the filling of trenches having a width of 140 nm and a depth of 380 nm with copper using an electroplating solution of the invention.

A copper seed layer was prepared in trenches having a width of 55 nm and a depth of 202 nm directly on a ruthenium barrier layer using a composition according to the invention based on 2-2'-bipyridine, imidazole and thiodiglycolic acid.

A. Material and Equipment

Substrate:

The substrate used in this example consisted of a silicon coupon having a length of 4 cm and a width of 4 cm, covered with a structured silicon oxide layer having trenches with a width of 55 nm and a depth of 202 nm that is itself coated with a layer of ruthenium (Ru) having a thickness of 3 nm deposited by reactive sputtering. The resistivity of the ruthenium layer was 250 ohm/square.

This ruthenium layer constitutes a copper-diffusion barrier as used in "dual-damascene" structures in the manufacture of copper interconnections of integrated circuits.

Electroplating Solution:

The electroplating solution used in this example was an aqueous solution containing $CuSO_4.(H_2O)_5$, 2,2'-bipyridine, imidazole and thiodiglycolic acid.

In this solution, the concentration of 2,2'-bipyridine was 4.5 mM and the concentration of imidazole was 13.5 mM. The concentration of $CuSO_4.(H_2O)_5$ was equal to 1.14 g/l, which is equivalent to 4.5 mM. The concentration of thiodiglycolic acid could vary from 5 to 200 ppm, for example equal to 100 ppm. The pH of the solution was between 7.8 and 8.2.

Equipment:

In this example, use was made of electrolytic deposition equipment composed of two parts: the cell intended to contain the electroplating solution equipped with a fluid recirculation system in order to control the hydrodynamics of the system, and a rotating electrode equipped with a sample holder suitable for the size of the coupons used (4 cm×4 cm). The electrolytic deposition cell comprised two electrodes:

- a copper anode,
- the structured silicon coupon coated with the ruthenium layer, which forms the cathode.

Connectors enabled the electrical contacting of the electrodes, which were connected by electrical wires to a potentiostat supplying up to 20 V and 2 A.

B. Experimental Protocol

The electroplating process used in this example comprised the following various consecutive steps:

Step 1: "Cold Entry"

The electroplating solution was poured into the cell.

The various electrodes were put in place and were brought into contact with the electroplating solution without bias. The bias was then applied.

Step 2: Formation of Copper Coating

The cathode was biased in galvanostatic mode within a current range from 5 mA (or 0.63 mA/cm$^2$) to 15 mA (or 1.88 mA/cm$^2$), for example 7.5 mA (or 0.94 mA/cm$^2$).

The duration of this step was generally between 15 sec and 1 minute in order to obtain a conformal layer of copper over the whole of the structure.

In this example, the duration of the electroplating step was 30 seconds in order to obtain a conformal copper layer having a thickness of 5 nm.

Step 3: "Hot Exit"

The cathode was withdrawn from the electroplating bath under bias. The cathode was then disconnected, and liberally rinsed with 18.2 MΩ deionized water, then dried using a gun delivering nitrogen at a pressure of the order of 2 bar.

C. Results Obtained

By applying the experimental protocol described above, a continuous and conformal copper layer was obtained (this being observed under a scanning electron microscope) having a thickness of 5 nm. The copper seed layer thus obtained has a sheet resistance of 72 ohm/square measured using a "4-point" measurement device well known to a person skilled in the art.

EXAMPLE 2

Trenches having a width of 55 nm and a depth of 202 nm were filled with copper directly onto a ruthenium barrier layer using a composition, according to the invention, based on 2,2'-bipyridine, imidazole and thiodiglycolic acid.

A. Material and Equipment

Substrate:

The substrate used in this example was identical to that of Example 1.

Electroplating Solution:

The electroplating solution used in this example was identical to that of Example 1.

No suppressor molecule, such as certain high molecular weight polymers, was added to the solution.

Equipment:

The equipment used in this example was identical to that of Example 1.

B. Experimental Protocol

The electroplating process used in this example comprised the following various consecutive steps:

Step 1: "Cold Entry"

The electroplating solution was poured into the cell.

The various electrodes were put in place and were brought into contact with the electroplating solution without bias. The bias was then applied.

Step 2: Formation of Copper Coating

The cathode was biased in galvanostatic mode within a current range from 5 mA (or 0.63 mA/cm$^2$) to 15 mA (or 1.88 mA/cm$^2$), for example 7.5 mA (or 0.94 mA/cm$^2$).

The duration of this step was generally between 1 minute and 10 minutes in order to obtain a complete filling of the trenches.

In this example, the duration of the electroplating step was 3 min in order to obtain a complete filling of trenches having a width of 55 nm and a depth of 202 nm.

Step 3: "Hot Exit"

The cathode was withdrawn from the electroplating bath under bias. The cathode was then disconnected, and liberally rinsed with 18.2 MΩ deionized water, then dried using a gun delivering nitrogen at a pressure of the order of 2 bar.

C. Results Obtained

By applying the experimental protocol described above, a complete filling of trenches having a width of 55 nm and a depth of 202 nm was obtained. The trenches thus filled do not have holes (voids) expressing an optimal bottom-up filling of the trenches.

Surprisingly, an optimal bottom-up filling was obtained in very thin trenches having a width of 55 nm without it being necessary to add a suppressor as described in the literature.

EXAMPLE 3

Trenches having a width of 140 nm and a depth of 380 nm were filled with copper on a TiN/Ti barrier layer covered with a 20 nm PVD copper layer using a composition, according to the invention, based on 2,2'-bipyridine, imidazole and thiodiglycolic acid.

A. Material and Equipment

Substrate:

The substrate used in this example consisted of a silicon coupon having a length of 4 cm and a width of 4 cm, covered with a structured silicon oxide layer having trenches with a width of 140 nm and a depth of 380 nm that is itself coated with a TiN/Ti bilayer having a thickness of 15 nm and a 20 nm copper layer deposited by reactive sputtering. The resistivity of the copper layer was 2.5 ohm/square.

Electroplating Solution:

The electroplating solution used in this example was identical to that of Example 1.

Equipment:

The equipment used in this example was identical to that used in Example 1.

B. Experimental Protocol

The electroplating process used in this example comprised the following various consecutive steps:

Step 1: "Cold Entry"

The electroplating solution was poured into the cell.

The various electrodes were put in place and were brought into contact with the electroplating solution without bias. The bias was then applied.

Step 2: Formation of Copper Coating

The cathode was biased in galvanostatic mode within a current range from 5 mA (or 0.63 mA/cm$^2$) to 15 mA (or 1.88 mA/cm$^2$), for example 10 mA (or 1.25 mA/cm$^2$).

The duration of this step was generally between 1 minute and 10 minutes in order to obtain a complete filling of the trenches.

In this example, the duration of the electroplating step was 9 min in order to obtain a complete filling of trenches having a width of 140 nm and a depth of 380 nm.

Step 3: "Hot Exit"

The cathode was withdrawn from the electroplating bath under bias. The cathode was then disconnected, and liberally rinsed with 18.2 MΩ deionized water, then dried using a gun delivering nitrogen at a pressure of the order of 2 bar.

Results Obtained

By applying the experimental protocol described above, a complete filling of trenches having a width of 140 nm and a depth of 380 nm was obtained. The trenches thus filled do not have holes (voids) expressing an optimal bottom-up filling of the trenches. The obtaining of an optimal filling of the trenches was demonstrated by the formation of an outgrowth of copper on top of the trenches as presented in the micrograph reproduced in FIG. 1.

COMPARATIVE EXAMPLE 4

Trenches having a width of 140 nm and a depth of 380 nm were filled with copper on a TiN/Ti barrier layer covered with a PVD copper layer using a composition based on 2,2'-bipyridine, imidazole and bis(3-sulphopropyl)disulphide (SPS).

A. Material and Equipment

Substrate:

The substrate used in this example was identical to that of Example 3.

Electroplating Solution:

The electroplating solution used in this example was an aqueous solution containing $CuSO_4.(H_2O)_5$, 2,2'-bipyridine, imidazole and bis(3-sulphopropyl)disulphide (SPS).

In this solution, the concentration of 2,2'-bipyridine was 4.5 mM and the concentration of imidazole was 13.5 mM. The concentration of $CuSO_4.(H_2O)_5$ was equal to 1.14 g/l (equivalent to 4.5 mM). The concentration of SPS could vary from 5 to 200 ppm, for example could be equal to 14 ppm. The pH of the solution was between 7.8 and 8.2.

Equipment:

The equipment used in this example was identical to that used in Example 1.

B. Experimental Protocol

The electroplating process used in this example comprised the following various consecutive steps:

Step 1: "Cold Entry"

The electroplating solution was poured into the cell.

The various electrodes were put in place and were brought into contact with the electroplating solution without bias. The bias was then applied.

Step 2: Formation of Copper Coating

The cathode was biased in galvanostatic mode within a current range from 5 mA (or 0.44 mA/cm$^2$) to 15 mA (or 1.3 mA/cm$^2$), for example 10 mA (or 1.25 mA/cm$^2$).

The duration of this step was generally between 1 minute and 10 minutes in order to obtain a complete filling of the trenches.

In this example, the duration of the electroplating step was 9 min in order to obtain a complete filling of trenches having a width of 140 nm and a depth of 380 nm.

Step 3: "Hot Exit"

The cathode was withdrawn from the electroplating bath under bias. The cathode was then disconnected, and liberally rinsed with 10 MΩ deionized water, then dried using a gun delivering nitrogen at a pressure of the order of 2 bar.

Results Obtained

Figure 2:
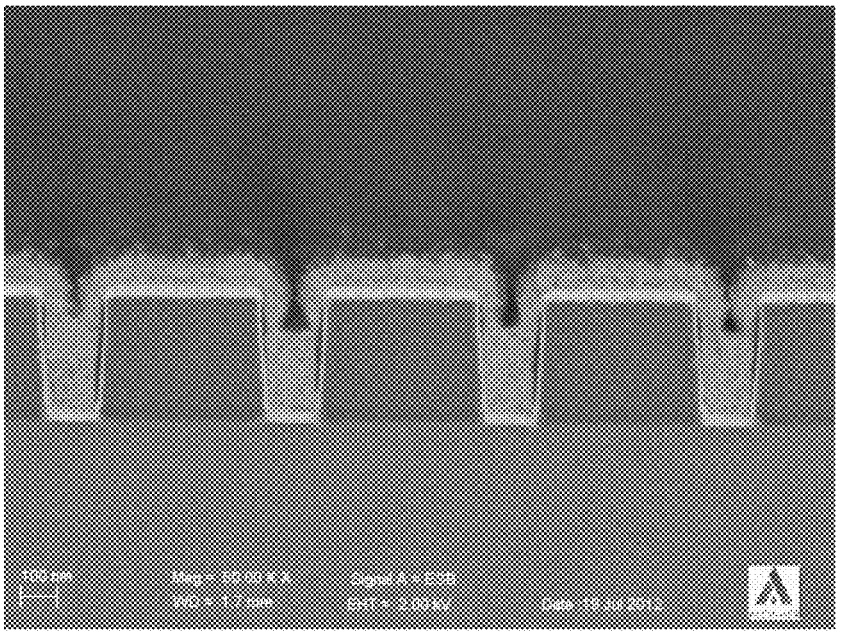
FIG. 2 represents the filling of trenches having a width of 140 nm and a depth of 380 nm with an electrolyte containing the combination of imidazole and SPS. It is possible to observe seams in the trenches.

By applying the experimental protocol described above, it was possible to observe an inhomogeneous growth of copper in the trenches. The copper morphology obtained proved to be very poor (very small grains of inhomogeneous shape) expressing an incompatibility of SPS with the formulation and the pH of the solution according to the invention. FIG. 2 shows the poor filling obtained with this comparative electroplating solution.

EXAMPLE 5

Trenches having a width of 55 nm and a depth of 165 nm were filled with copper on a TiN/Ti barrier layer covered with a 10 nm PVD copper layer using a composition, according to the invention, based on 2,2'-bipyridine, imidazole and thiodiglycolic acid.

A. Material and Equipment

Substrate:

The substrate used in this example consisted of a silicon coupon having a length of 4 cm and a width of 4 cm, covered with a structured silicon oxide layer having trenches with a width of 55 nm and a depth of 165 nm that is itself coated with a TiN/Ti bilayer having a thickness of 10 nm and a 10 nm copper layer deposited by reactive sputtering. The resistivity of the copper layer was 8 ohm/square.

Electroplating Solution:

The electroplating solution used in this example was identical to that of Example 1.

Equipment:

The equipment used in this example was identical to that used in Example 1.

B. Experimental Protocol

The electroplating protocol used in this example comprised the following various consecutive steps:

Step 1: "Cold Entry"

The electroplating solution was poured into the cell.

The various electrodes were put in place and were brought into contact with the electroplating solution without bias. The bias was then applied.

Step 2: Formation of Copper Coating

The cathode was biased in the galvanopulsed mode so that the frequency of the cathode pulses was very high, between 0.1 and 50 kHz, for example 10 kHz. The current range used was between 5 mA (1.88 mA/cm$^2$) and 60 mA (7.52 mA/cm$^2$), for example 35 mA (4.38 mA/cm$^2$). The cathode pulses were spaced apart by rest times (without current) having a frequency of between 0.1 and 50 kHz, for example 5 kHz.

The duration of this step was generally between 30 seconds and 10 minutes in order to obtain a complete filling of the trenches.

The duration of the electroplating step was 4 minutes in order to obtain a complete filling of trenches having a width of 55 nm and a depth of 165 nm.

Step 3: "Hot Exit"

The cathode was withdrawn from the electroplating bath under bias. The cathode was then disconnected, and liberally rinsed with 18.2 MΩ deionized water, then dried using a gun delivering nitrogen at a pressure of the order of 2 bar.

Results Obtained

By applying the experimental protocol described above, a complete filling of trenches having a width of 55 nm and a depth of 165 nm was obtained. The trenches thus filled do not have holes (voids) expressing an optimal bottom-up filling of the trenches.

COMPARATIVE EXAMPLE 6

Trenches having a width of 55 nm and a depth of 202 nm were filled with copper onto a ruthenium barrier layer using a composition of 2,2'-bipyridine, pyridine and thiodiglycolic acid.

A. Material and Equipment

Substrate:

The substrate used in this example was identical to that of Example 1.

Electroplating Solution:

The electroplating solution used in this example was identical to that of Example 1, apart from the replacement of imidazole by pyridine in an identical concentration, i.e. 13.5 mM. The pH of the solution was between 5.8 and 6.0.

Equipment:

The equipment used in this example was identical to that of Example 1.

B. Experimental Protocol

The electroplating process used in this example comprised the following various consecutive steps:

Step 1: "Cold Entry"

The electroplating solution was poured into the cell.

The various electrodes were put in place and were brought into contact with the electroplating solution without bias. The bias was then applied.

Step 2: Formation of Copper Coating

The cathode was biased in galvanostatic mode within a current range from 5 mA (or 0.63 mA/cm$^2$) to 15 mA (or 1.88 mA/cm$^2$), for example 14.4 mA (or 1.80 mA/cm$^2$).

The duration of this step was generally between 1 minute and 10 minutes in order to obtain a complete filling of the trenches.

In this example, the duration of the electroplating step was 1 minute and 35 seconds in order to obtain a complete filling of trenches having a width of 55 nm and a depth of 202 nm.

Step 3: "Hot Exit"

The cathode was withdrawn from the electroplating bath under bias. The cathode was then disconnected, and liberally rinsed with 18.2 MΩ deionized water, then dried using a gun delivering nitrogen at a pressure of 2 bar.

Results Obtained

By applying the experimental protocol described above, a filling of trenches having a width of 55 nm and a depth of 202 nm was obtained that has small holes on the side walls, "side wall voids". Furthermore, an advanced study of the surface of the copper thus electroplated shows a roughness greater than that of the electroplating solution with imidazole as described in Example 2, expressing a worse nucleation of the copper in the presence of pyridine with respect to imidazole. These observations could prove even more unfavourable for thinner trenches where the nucleation density proves to be a crucial parameter. The electroplating solution with imidazole is therefore preferred.

The invention claimed is:

1. An electrolyte suitable for filling trenches of a semiconductor substrate, said trenches having a width being less than 200 nm, the electrolyte having a pH higher than 6.7, and comprising:

copper ions in a concentration between 0.4 and 40 mM;

bipyridine in a concentration between 0.4 and 40 mM;

imidazole in a concentration being between 1.2 and 120 mM; and thiodiglycolic acid in a concentration being between 1 and 500 mg/l, wherein the bipyridine concentration represents from 0.5 to 2 molar equivalent of the concentration of copper ions and the imidazole concentration represents from 1 to 5 molar equivalents of the concentration of copper ions.

2. The electrolyte according to claim 1, wherein the pH is between 7.5 and 8.5.

3. The electrolyte according to claim 1, wherein the pH is of the order of 8.

4. The electrolyte according to claim 1, wherein the copper ions are derived from a compound chosen from copper sulphate, copper chloride, copper nitrate and copper acetate.

5. The electrolyte according to claim 1, comprising less than 50 ppm of chlorine ions.

6. The electrolyte according to claim 1, wherein the bipyridine is in the form of 2,2'-bipyridine.

7. The electrolyte according to claim 1, additionally comprising a leveller and/or a brightener.

8. The electrolyte according to claim 1, comprising a solvent predominantly comprising water.

9. The electrolyte according to claim 1, wherein the bipyridine concentration represents from 0.75 to 1.25 molar equivalent of the concentration of copper ions.

10. The electrolyte according to claim 1, wherein the bipyridine concentration represents 1 molar equivalent of the concentration of copper ions.

11. The electrolyte according to claim 1, wherein the imidazole concentration represents from 2 to 4 molar equivalents of the concentration of copper ions.

12. The electrolyte according to claim 4, wherein the imidazole concentration represents 3 molar equivalents of the concentration of copper ions.

13. A process for electroplating copper onto a copper-diffusion barrier layer, and which is optionally covered with a copper seed layer, said barrier layer covering one surface of a semiconductor substrate, the surface of the substrate having a flat part and a set of at least one trench having a width of less than 200 nm, the process comprising the steps of:

bringing the barrier layer optionally covered with the copper seed layer into contact with the electrolyte according to claim 1, biasing of the surface of the barrier layer optionally covered with the copper seed layer at an electric potential that enables the electroplating of copper onto the barrier layer or the copper seed layer, so as to form a copper deposit on said barrier layer.

14. The process according to claim 13, wherein the barrier layer is covered with the copper seed layer.

15. The process according to claim 13, wherein when the barrier layer is not optionally covered, the biasing is carried out so as to form a copper seed layer on said barrier layer.

16. The process according to claim 13, wherein the biasing is carried out so as to completely fill the volume of the trench with copper.

17. The process according to claim 13, wherein the barrier layer comprises at least one material chosen from cobalt (Co), ruthenium (Ru), tantalum (Ta), titanium (Ti), tantalum nitride (TaN), titanium nitride (TiN), tungsten (W), titanium tungsten (TiW) and tungsten carbonitride (WCN).

18. The process according to claim 13, wherein, during the biasing, the substrate is rotated at a speed between 20 and 600 rpm.

19. The process according to claim 13, wherein the trench has an aspect ratio of greater than 2/1.

20. The process according to claim 19, wherein the aspect ratio is greater than 3/1.

21. The process according to claim 13, wherein the biasing of the surface is carried out in DC mode by applying a current per unit area within a range from 0.2 $mA/cm^2$ to 50 $mA/cm^2$, and in that the bias time is at least 5 seconds.

22. The process according to claim 13, wherein the biasing of the surface is carried out in galvano-pulsed mode such that the frequency of the bias periods is between 0.1 kHz and 50 kHz.

23. The process according to claim 22, wherein the bias periods are spaced apart by rest times at zero current, the frequency of which is between 0.1 kHz and 50 kHz.

24. The process according to claim 23, wherein the frequency of the bias periods is equal to 10 kHz, and the frequency of the rest times is equal to 5 kHz.

25. The process according to claim 22, wherein the biasing of the surface is carried out with a current having a maximum intensity of between 0.01 and 10 $mA/cm^2$.

* * * * *